US005197229A

United States Patent [19]

Kanamaru et al.

[11] Patent Number: 5,197,229

[45] Date of Patent: Mar. 30, 1993

[54] NUMERICALLY CONTROLLED CHAMFERING APPARATUS FOR A GLASS PLATE

[75] Inventors: Shigeyuki Kanamaru, Tokyo; Kouichirou Nakai, Yokohama, both of Japan

[73] Assignee: Asahi Glass Company Ltd., Tokyo, Japan

[21] Appl. No.: 762,259

[22] Filed: Sep. 20, 1991

Related U.S. Application Data

[63] Continuation of Ser. No. 444,131, filed as PCT/JP88/00331 on Mar. 31, 1988, abandoned.

[30] Foreign Application Priority Data

Sep. 26, 1986 [JP] Japan ..... 61-227512

[51] Int. Cl.[5] ..... B24B 9/10

[52] U.S. Cl. ..... 51/165.77; 51/283 E

[58] Field of Search ..... 51/165.71, 165.76, 165.92, 51/283 E, 283 R, 100 R, 34 A, 34 C, 165.77; 65/61

[56] References Cited

U.S. PATENT DOCUMENTS

| | | | |
|---|---|---|---|
| 4,228,617 | 10/1980 | Bando | 51/283 E |
| 4,375,738 | 3/1983 | Bando | 51/283 E |
| 4,478,007 | 10/1984 | Bavelloni | 51/100 R |
| 4,519,167 | 5/1985 | Halberschmidt et al. | 51/100 R |
| 4,587,764 | 5/1986 | Leone et al. | 51/283 E |
| 4,604,835 | 8/1986 | Borin | 51/165.87 |
| 4,633,408 | 12/1986 | Reinmold | 51/283 E |
| 4,667,443 | 5/1987 | Sakuraii et al. | 51/165.71 |
| 4,698,088 | 10/1987 | Bando | 65/174 |
| 4,756,124 | 7/1988 | Rossi | 51/283 E |

FOREIGN PATENT DOCUMENTS

| | | | |
|---|---|---|---|
| 0114141 | 7/1984 | European Pat. Off. . | |
| 3546491 | 3/1987 | Fed. Rep. of Germany . | |
| 0177255 | 10/1983 | Japan | 51/165.77 |
| 59-47152 | 3/1984 | Japan . | |

*Primary Examiner*—Robert A. Rose

*Attorney, Agent, or Firm*—Oblon, Spivak, McClelland, Maier & Neustadt

[57] ABSTRACT

A numerically controlled chamfering apparatus for a glass plate wherein a numerical instruction indicating a shape resembling the shape of the peripheral edge of a glass plate is previously given, and a chamfering wheel is moved along the peripheral edge of the glass plate on the basis of the numerical instruction to grind the peripheral edge of the glass plate to thereby perform chamfering, the numerically controlled chamfering apparatus being characterized by comprising a base, a fitting holder provided on the base to hold the glass plate, an X-axis moving means for moving a chamfering wheel on the base in the direction of an X axis, a Y-axis moving means for moving the chamfering wheel on the base in the direction of a Y axis which intersects the X axis at a right angle, a turning means for turning the chamfering wheel on the base, a pushing force applying means which slidably supports the chamfering wheel on the base in the direction of the normal line of the peripheral edge of the glass plate so as to cause advance and retreat movements of the chamfering wheel to the peripheral edge of the glass plate, and a control section for adjusting a quantity of the advance or retreat movement of the chamfering wheel by controlling the pushing force applying means.

7 Claims, 4 Drawing Sheets

NUMERICALLY CONTROLLED CHAMFERING APPARATUS FOR A GLASS PLATE

This application is a continuation of application No. 07/444,131, filed as PCT/JP88/00331 on Mar. 31, 1988, now abandoned.

TECHNICAL FIELD

The present invention relates to a numerically controlled chamfering apparatus for a glass plate. More particularly, the present invention relates to a numerically controlled chamfering apparatus for a glass plate wherein a numerical instruction indicating a shape resembling the shape of the peripheral edge of a glass plate is previously given, and a chamfering wheel is moved along the peripheral edge of the glass plate such as a window glass for an automobile on the basis of the numerical instruction to grind the peripheral edge of the glass plate to thereby perform the chamfering of the peripheral edge of the glass plate.

BACKGROUND TECHNIQUE

Heretofore, there has been known as a numerically controlled chamfering apparatus for a glass plate of this kind a chamfering apparatus disclosed in Japanese Unexamined Patent Publication 37040/1984. The numerically controlled chamfering apparatus for a glass plate comprises a fitting holder for setting a glass plate having a desired shape horizontally and a chamfering wheel provided at the upper side of the fitting holder so as to be movable to a desired position by two driving systems having an X axis and a Y axis intersecting the X axis perpendicularly, wherein the chamfering wheel comprises a Z axis system which horizontally turns an arm supporting the chamfering wheel by a servo motor, and the arm has the same center axis as that for turning horizontally in the horizontally turning mechanism, the arm having a degree of freedom around the central axis as a supporting point. As the arm has such degree of freedom, problems of an error in shape of a glass plate, an error in position of the glass plate and so on can be eliminated.

In the numerically controlled chamfering apparatus for a glass plate disclosed in Japanese Unexamined Patent Publication No. 37040/1984, however, there were problems that because a point for driving by the X and Y driving systems did not coincide with a point for grinding the glass plate, (1) it was unavoidable that a speed of grinding at a corner portion greatly decreased in comparison with that at a linear portion, and (2) a centrifugal force was produced at a swing arm and a wheel spindle at the corner portion, however, there was no back-up system. As a result, it was difficult to uniformly chamfer the peripheral edge of a glass plate.

Further, since the shape of glass plates to be supplied are slightly different from each other. The diameter of the chamfering wheel becomes small due to wearing. In a case of the replacement of a chamfering wheel, the function of grinding of a fresh chamfering wheel is different from that of the chamfering wheel which has been replaced. In such cases, the conventional numerically controlled chamfering apparatus for a glass plate could not cope enough with a change of the function of grinding of the chamfering wheel or another change, and there were a disadvantage that a quantity of chamfering varies for products.

SUMMARY OF THE INVENTION

In view of the above-mentioned circumstances, it is an object of the present invention to provide a numerically controlled chamfering apparatus for a glass plate capable of machining at a constant quantity of chamfering even when a change in the function of grinding of a chamfering wheel takes place.

The foregoing and other objects of the present invention have been attained by providing a numerically controlled chamfering apparatus for a glass plate wherein a numerical instruction indicating a shape resembling the shape of the peripheral edge of a glass plate is previously given, and a chamfering wheel is moved along the peripheral edge of the glass plate on the basis of the numerical instruction to grind the peripheral edge of the glass plate to thereby perform chamfering, said numerically controlled chamfering apparatus being characterized by comprising a base, a fitting holder provided on the base to hold the glass plate, an X-axis moving means for moving a chamfering wheel on the base in the direction of an X axis, a Y-axis moving means for moving the chamfering wheel on the base in the direction of a Y axis which intersects the X axis at a right angle, a turning means for turning the chamfering wheel on the base, a pushing force applying means which slidably supports the chamfering wheel on the base in the direction of the normal line of the peripheral edge of the glass plate so as to cause advance and retreat movements of the chamfering wheel to the peripheral edge of the glass plate, and a control section for adjusting a quantity of the advance or retreat movement of the chamfering wheel by controlling the pushing force applying means.

In the present invention, a constant quantity of chamfering can always be obtained even when an error in shape of a glass plate, an error in diameter of a chamfering wheel and so on take place.

BEST MODE OF AN EMBODIMENT OF THE PRESENT INVENTION

Figure 1:
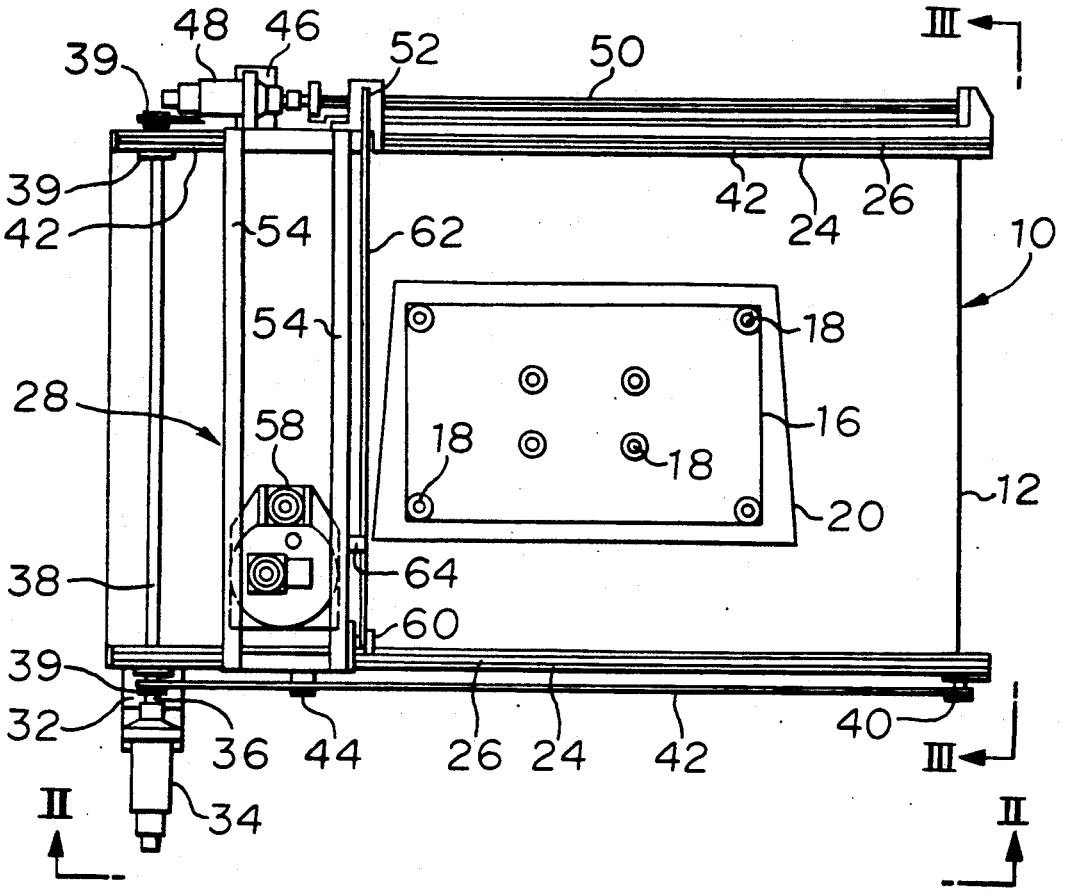
FIG. 1 is a plane view of a numerically controlled chamfering apparatus for a glass plate according to the present invention.

Preferred embodiments of the numerically controlled chamfering apparatus for a glass plate of the present invention will be described in detail with reference to the drawings.

As shown in the drawings, leg portions 14, 15 are provided at the central portion of a base frame 12 of a numerically controlled chamfering apparatus for a glass plate 10, and a table 16 is attached to the top of the leg portions. A plurality of attracting pads 18, 18, . . . are arranged in a same level on the table 16 so that a glass plate 20 can be attracted and fixed in a horizontal plane.

At four corners of the base frame 12, leg portions 22, 22, 22, 22 are set up. A pair of X axis fixed frames 24, 24 are provided on the leg portions 22 in the direction of right and left in FIG. 1, and further, X axis guides 26, 26 are respectively provided at the X axis fixed frames 24, 24 in the direction of right and left. Between the paired X axis guides 26, 26, a Y axis movable frame 28 is extended in the longitudinal direction in FIG. 1 so that the Y axis movable frame 28 can run in the right and left direction (the X axis direction) in FIG. 1 by the X axis guides 26, 26 through a bearing 30 which is shown in FIG. 2.

Figure 2:
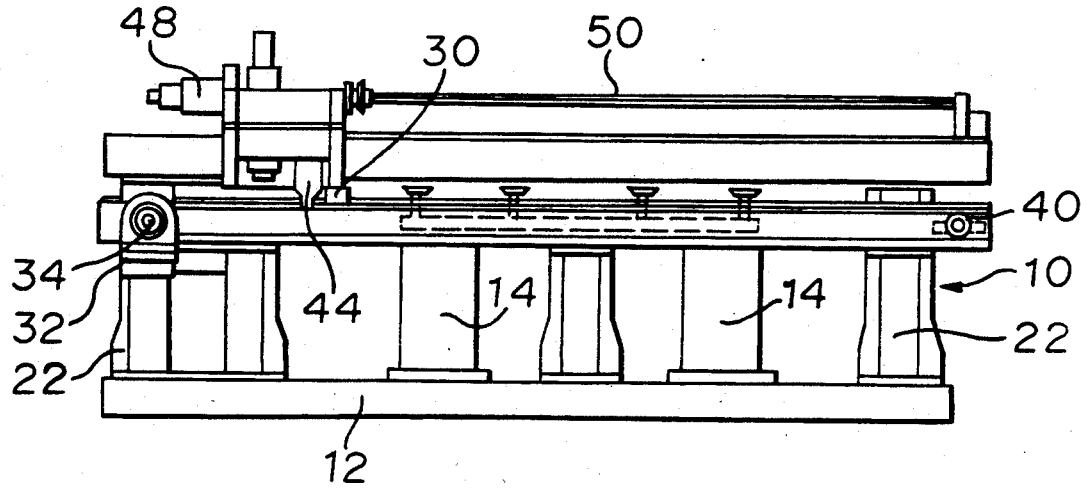
FIG. 2 is a side view of the numerically controlled chamfering apparatus for a glass plate taken along a line II—II in FIG. 1.

An X axis driving servo motor 34 is attached through a bracket 32 to the leg portion 22 located at the lower left corner in FIG. 1, and the output shaft 36 of the servo motor 34 is directly connected to an X axis driving shaft 38 in the longitudinal direction in FIG. 1. Sprockets 39, 39 are respectively provided at both ends of the X axis driving shaft 38, and sprockets 40, 40 (only one is shown) are respectively provided at the X axis fixed frames 24, 24 so as to correspond to the respective sprockets 39, 39. Chains 42, 42 are respectively extended between the sprockets 39 and 40, and the Y axis movable frame. 28 is attached to the chains 42, 42 by the aid of fitting pieces 44, 44 (only one is shown). Accordingly, when the servo motor 34 is actuated to rotate, the Y axis movable frame 28 is moved in the X axis direction (in the direction of right and left in FIG. 1).

A Y axis driving servo motor 48 is attached to the X axis fixed frame 24 through a bracket 46, and a spline shaft 50 is connected to the output shaft of the servo motor 48. A spline nut 52 is attached to the spline shaft 50 so as to be slidable in its axial direction. On the other hand, Y axis guides 54, 54 are attached to the upper part of the Y axis movable frame 28 in the longitudinal direction in FIG. 1, and a chamfering head 58 which will be described hereinafter supported by the X axis guides 54 so as to be movable in the longitudinal direction (the direction of Y axis) in FIG. 1 through a bearing 56 shown in FIG. 3.

On the other hand, a sprocket is formed at the outer circumference of the spline nut 52, and a sprocket 60 is pivottally supported by the Y axis movable frame 28 in correspondence to the spline nut 52. Further, a chain 62 is extended between the spline nut 52 and the sprocket 60, and the chain 62 is connected to the chamfering head 58 through a fitting piece 64. Accordingly, when the servo motor 48 is actuated to rotate, the chamfering head 58 is moved in the Y axis direction (in the longitudinal direction in FIG. 1).

Figure 4:
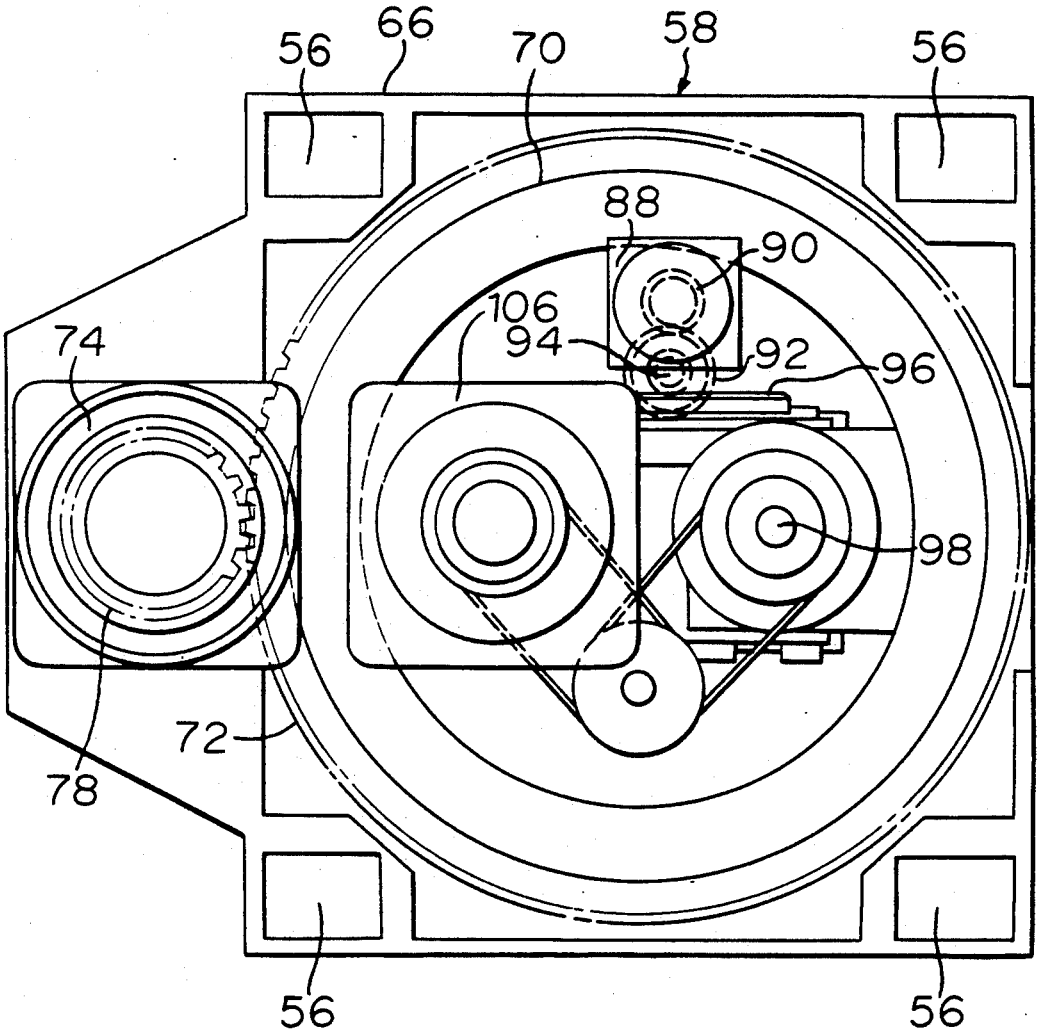
FIG. 4 is a plane view of a chamfering head for the numerically controlled chamfering apparatus for a glass plate according to the present invention.
Figure 5:
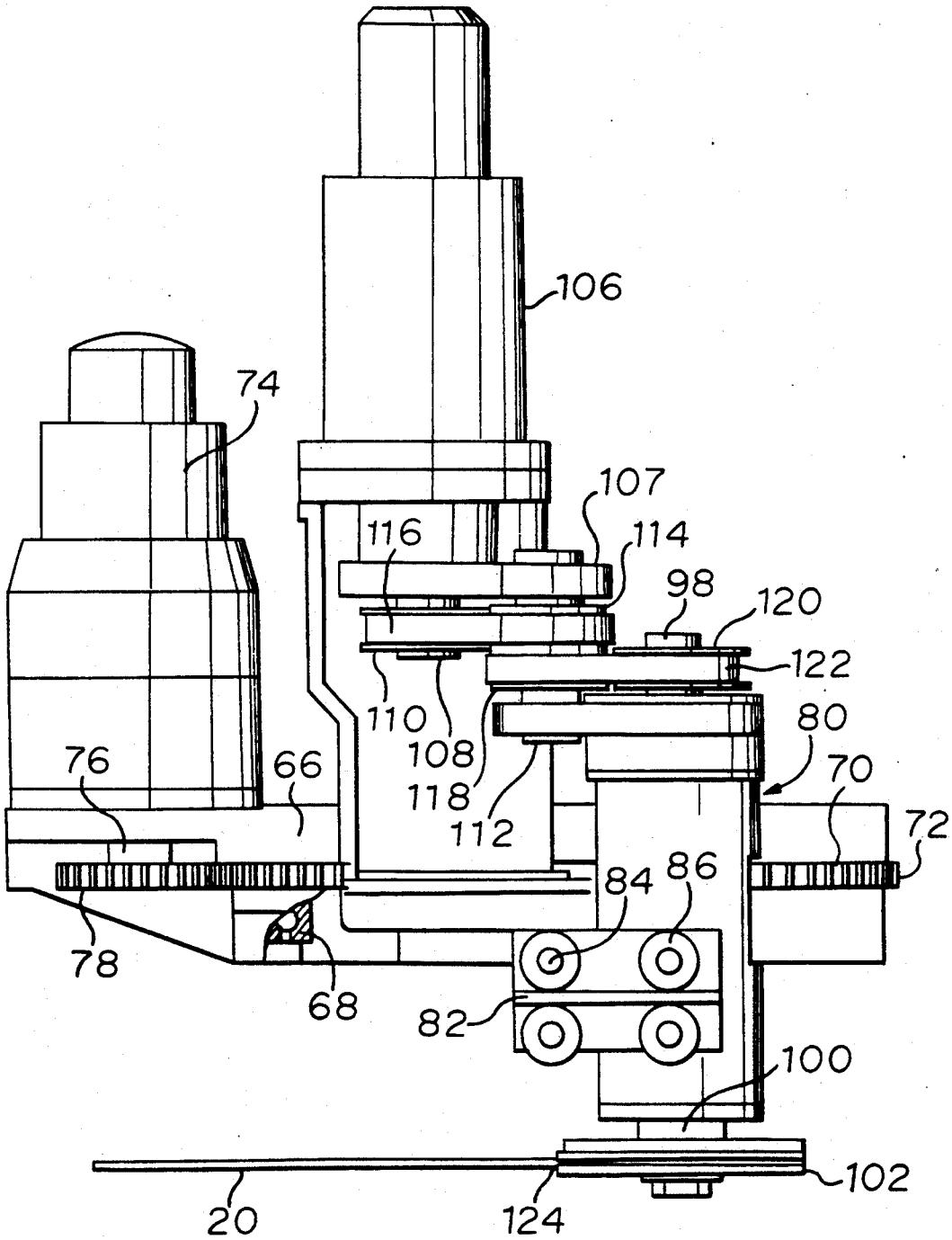
FIG. 5 is a side view of the chamfering head.

FIG. 4 is a plane view of the chamfering head 58, and FIG. 5 is a side view of the chamfering head 58. As shown in FIG. 5, a circular plate 70 is rotatably supported on and by a frame 66 for the chamfering head 58 through a bearing 68, and a gear 72 is formed at the circumference of the circular plate 70. On the other hand, a motor 74 is attached to the frame 66, and a gear 78 is fixed to the output shaft 76 of the motor 74 so that the gear 78 is interlocked with the gear 72 of the circular plate 70. Accordingly, when the motor 74 is actuated to rotate, the circular plate 70 is actuated to rotate.

A spindle housing 80 is attached to the circular plate 70 so as to be movable in the right and left direction in FIGS. 4 and 5. Namely, a guide bar 82 attached to the spindle housing 80 is guided between a pair of guide rollers 84, 86 which are arranged keeping a predetermined space therebetween so as to be movable in the direction of right and left in FIGS. 4 and 5. On the other hand, a servo motor 88 is provided on the circular plate 70 as shown in FIG. 4; a gear 90 is formed at the output shaft of the servo motor 88; and the gear 90 is interlocked with a rack 96 through idle gears 92, 94, which is formed at a side surface of the spindle housing 80. Accordingly, when the motor 88 is rotated, the spindle housing 80 is guided by the guide rollers 84, 86 so that it is moved in the direction of right and left in FIGS. 4 and 5. A spindle (98) supported in a rotatable manner in the spindle housing 80, and a chamfering wheel 102 is attached to the lower portion 100 of the spindle 98. The chamfering wheel 102 is so adapted as to come in contact with the peripheral edge of a glass plate 20 to grind the peripheral edge of the glass plate 20 to thereby perform the chamfering operations as described hereinafter. The spindle 98 is rotated by a motor 106 through a transmission mechanism which will be described hereinafter. Namely, a pulley 110 is provided at the output shaft 108 of the motor 106, and a timing belt 116 is extended between the pulley 110 and a pulley 114 for an intermediate shaft 112 supported by an arm 107 which is provided integrally with the motor 106. Further, a timing belt 122 is extended between a pulley 118 of the intermediate shaft 112 and a pulley 120 of a spindle 98. Thus, a rotational force from the motor 106 is transferred to the chamfering wheel 102 attached to the lower portion of the spindle 98.

The embodiment of the present invention having the above-mentioned structure functions as follows.

First of all, a glass plate 20 is fixed onto the table 16 through the attracting pads 18, 18, . . . . The chamfering wheel 102 is rotated by driving the motor 106. In this state, the X axis driving motor 34, the Y axis driving motor 48, the horizontally turning motor 74 and the pushing motor 88 are actuated to be rotated so that the point of grinding 124 of the chamfering wheel 102 is moved along the peripheral edge of the glass plate 20. In this case, it is necessary for the chamfering wheel 102 that the direction of pushing of the wheel 102 is vertical to the peripheral edge of the glass plate 20. This can be accomplished by controlling the turning motion of the chamfering wheel so as to have an angle of 90° to a composite vector of the X axis and the Y axis during the grinding operations.

On the other hand, it is sometimes difficult to keep the composite speed of the X and Y axes constant during the grinding due to the shape of the glass plate 20. Accordingly, a torque of the wheel 102 is controlled by a pushing force on the basis of the composite speed. Namely, the pushing force is controlled to generate a wheel torque which corresponds to the composite speed on real time basis in accordance with a previously determined composite speed or a wheel torque curve.

There is a case that the same quantity of grinding can not be obtained even by producing the same wheel torque depending on the ability of grinding of chamfering wheels 102 because the ability of the chamfering wheels 102 varies as they operate for a large number of glass plates. Accordingly, it is necessary to control the ability of grinding the wheels 102. By controlling the ability of grinding the wheels 102, the quantity of grinding to be required can he kept constant.

The ability of grinding of the chamfering wheels 102 is generally in proportion to a ratio of the pushing force to the wheel torque. Namely, when the ratio of $$\frac{\text{Pushing force}}{\text{Wheel torque}}$$

is large, the ability of grinding of the wheel is low. On the other hand, when it is small, the ability is high.

By utilizing the above-mentioned relation, the wheel torque for every composite speed during the grinding is determined by using the following equation, and the pushing force of the chamfering wheel 102 is controlled to produce a torque as a target value.

$$\left(\frac{\text{Pushing force measured at the last time}}{\text{Wheel torque measured at the last time (the ability of grinding of the wheel)}} \div \text{coefficient}\right)^{K} \times$$

$$\text{torque for every composite speed} = \text{target value of wheel torque}$$

where pushing force measured at the last time: the average value of values obtained by sampling data of pushing force when chamfering operations are carried out, wheel torque measured at the last time: the average value of values obtained by sampling data of wheel torque when chamfering operations are carried out at the last time, coefficient: a constant (the quantity of grinding can be changed by changing it), K: a constant (obtained by experience). Thus, by using the pushing force and the wheel torque of the chamfering wheel 102 measured at the last time chamfering operations, the target value of the wheel at this time is determined, and the pushing force of the chamfering wheel 102 is controlled so that the target value of the torque is produced.

In this case, however, since there is no data to be learned for the first time after replacement of wheel and wheel dressing, an estimated value which has been previously obtained by experience is used as the ability of grinding of the wheel. The glass plate processed first after the replacement of wheel and after wheel dressing is also controlled to produce a requisite quantity of grinding.

By using the above-mentioned controlling system, it is possible that the same quantity of grinding can be obtained for an in curved portion, an out-curved portion and a linear portion. A quantity of grinding can be maintained constant by self-determining the ability of grinding of the wheel and without relying on the ability of grinding of the wheel.

Figure 3:
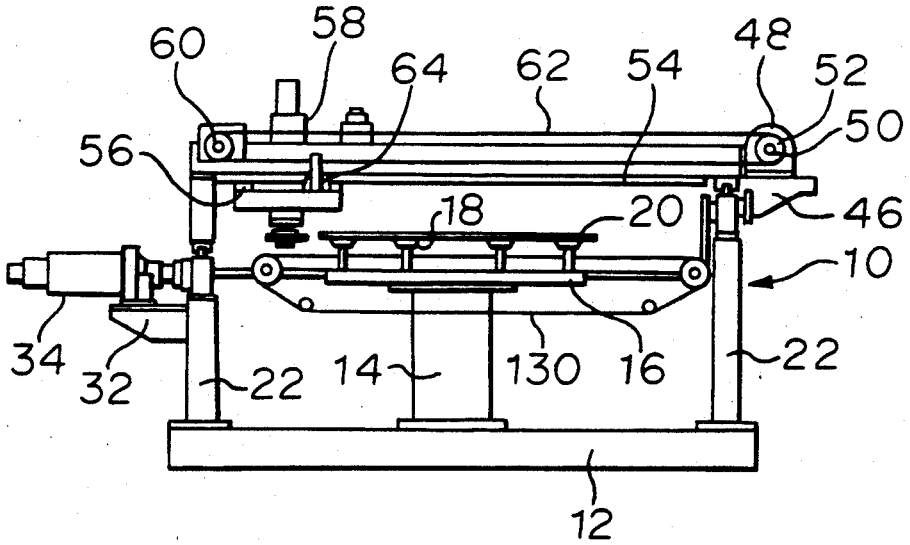
FIG. 3 is a side view of the numerically controlled chamfering apparatus for a glass plate taken along a line III—III in FIG. 1.

To transfer the glass plate 20 having subjected to the chamfering operations to the outside of the chamfering operation system is as follows. For instance, a V-belt driving type glass plate transferring conveyor 130 as shown in FIG. 3 is arranged between the attracting pads 18, 18, . . . ; the entirety of the conveyor 130 is raised as soon as the glass plate 20 is released from the attracting pads 18, 18, . . . so that the glass plate 20 is raised to a level higher than the upper plane of the pads 18, and the glass plate is transferred out of the system.

The above-mentioned embodiment provides the following effect.

(1) It is possible to control as desired a quantity of grinding by detecting and-controlling a torque for grinding. For instance, uniform chamfering of the peripheral edge of a single glass plate is possible. Further, it is possible to form chamfering and polishing portion at a part of a glass plate and a thin chamfering portion at the other part of it.

(2) Since a change of the sharpness of the chamfering wheel can be detected, a timing of the dressing and a timing of the replacement of the wheel can be foreseen.

(3) Since the point used by the X and Y driving systems coincides with the point of grinding of a glass plate, and the pushing force applying means is provided, a speed of processing a corner portion of the glass plate can be increased.

As described above, in accordance with the numerically controlled chamfering apparatus for a glass plate according to the present invention, the pushing force applying means for controlling a torque of grinding by causing advance and retreat movements of the chamfering wheel along the direction of the normal line of the peripheral edge of the glass plate in addition to the X axis and Y axis driving systems and the horizontally turning driving system for driving the chamfering wheel. Accordingly, it is possible to process at a constant quantity of chamfering even when the shape of glass plates and the diameter of the chamfering wheel vary.

We claim:

1. A numerically controlled chamfering apparatus for a glass plate wherein a numerical instruction indicating a shape resembling the shape of the peripheral edge of a glass plate is previously given, and a chamfering wheel is moved along the peripheral edge of the glass plate on the basis of the numerical instruction to grind the peripheral edge of the glass plate to thereby perform chamfering, said numerically controlled chamfering apparatus comprising:

a base;

a fitting holder provided on the base to hold the glass plate;

an X-axis moving means for moving a chamfering wheel on the base in the direction of an X axis;

a Y-axis moving means for moving the chamfering wheel on the base in the direction of a Y axis which intersects the X axis at a right angle;

a turning means for turning the chamfering wheel on the base;

a pushing force applying means which slidably supports the chamfering wheel on the base in the direction of the normal line of the peripheral edge of the glass plate so as to cause advance and retreat movements of the chamfering wheel relative to the peripheral edge of the glass plate; and a control section for calculating a target value of wheel torque and for adjusting a quantity of the advance or retreat movement of the chamfering wheel by controlling the pushing force applying means until said target value of wheel torque is achieved, said control section calculating said target value of wheel torque based upon the composite speed of the chamfering wheel along the X and Y axes, previously sampled pushing force values, and previously sampled wheel torque values

2. The chamfering apparatus according to claim 1, wherein a circular plate is rotatably supported by a frame in a chamfering head, and the circular plate is rotated by a motor whereby the chamfering wheel mounted on the circular plate is turned.

3. The chamfering apparatus according to claim 1, wherein a spindle housing is attached to a circular plate rotatably mounted on a frame in a chamfering head so as to be movable horizontally in any direction; the turning means is adapted to coincide the moving direction of the spindle housing with the direction of the normal line of the peripheral edge of the glass plate; the spindle housing is moved toward the glass plate in this state and the chamfering wheel mounted on the spindle housing is pushed to the peripheral edge of the glass plate.

4. A numerically controlled chamfering apparatus, comprising:

means for supporting a glass plate in a substantially horizontal plane;

a pair of Y-axis guides slidably supporting a chamfering head frame such that the chamfering head frame is slidable along a Y-axis;

a pair of X-axis guides slidably supporting said Y-axis guides thereon such that said Y-axis guides are slidably along an X-axis;

a Y-axis motor for translating said chamfering head frame along said Y-axis guides;

a circular plate rotatably mounted on said chamfering head frame;

means for rotating said circular plate relative to said chamfering head frame;

a spindle housing mounted on said circular plate, said spindle housing having a guide bar fixed thereto and a spindle rotatably mounted therein;

a chamfering wheel carried at a first end of said spindle;

means for rotating said spindle drivingly connected to a second end of said spindle;

a plurality of guide rollers mounted on said circular plate and slidably supporting said guide bar therebetween;

a pushing force applying means for translating said spindle housing across said circular plate to thereby adjust a contact pressure between said chamfering wheel and said glass plate; and a control section for calculating a target value of wheel torque and for adjusting a quantity of the advance or retreat movement of the chamfering wheel by controlling the pushing force applying means until said target value of wheel torque is achieved, said control section calculating said target value of wheel torque based upon the composite speed of the chamfering wheel along the X- and Y-axes, previously sampled pushing force values, and previously sampled wheel torque values.

5. The numerically controlled chamfering apparatus of claim 4, wherein a rack is provided on said spindle housing, and said pushing force applying means includes a motor and an arrangement of gears transferring movement from said motor to said rack.

6. The numerically controlled chamfering apparatus of claim 1, wherein said pushing force applying means includes a spindle housing rotatably carrying said chamfering wheel;

a rack provided on said spindle housing;

a motor; and an arrangement of gears transferring movement from said motor to said rack.

7. The numerically controlled chamfering apparatus of claim 6, wherein said spindle housing includes a guide bar and wherein a pair of guides rollers is mounted on said base, said guide bar being received between said pair of guide rollers to guide said advance and retreat movements of said chamfering wheel.

* * * * *

UNITED STATES PATENT AND TRADEMARK OFFICE

CERTIFICATE OF CORRECTION

PATENT NO. : 5,197,229

DATED : March 30, 1993

INVENTOR(S) : Shigeyuki Kanamaru et al.

It is certified that error appears in the above-identified patent and that said Letters Patent is hereby corrected as shown below:

On the title page, Item [30],

The Foreign Application Priority Data should be omitted.

Signed and Sealed this

Thirtieth Day of November, 1993

*Attest:*

*Attesting Officer*

BRUCE LEHMAN

*Commissioner of Patents and Trademarks*